US006513496B2

(12) United States Patent
Yomogida

(10) Patent No.: US 6,513,496 B2
(45) Date of Patent: Feb. 4, 2003

(54) FUEL INJECTION CONTROLLER OF ENGINE

(75) Inventor: Koichiro Yomogida, Fujisawa (JP)

(73) Assignee: Isuzu Motors Limited, Tokyo (JP)

( * ) Notice: Subject to any disclaimer, the term of this patent is extended or adjusted under 35 U.S.C. 154(b) by 48 days.

(21) Appl. No.: 09/872,724

(22) Filed: Jun. 1, 2001

(65) Prior Publication Data

US 2001/0050072 A1 Dec. 13, 2001

(30) Foreign Application Priority Data

Jun. 7, 2000 (JP) ..... 2000-171176

(51) Int. Cl.[7] ..... F02D 41/36
(52) U.S. Cl. ..... 123/436; 123/687; 123/673
(58) Field of Search ..... 123/436, 673, 123/687

(56) References Cited

U.S. PATENT DOCUMENTS 4,495,920 A * 1/1985 Matsumura et al. ..... 123/436
4,667,634 A * 5/1987 Matsumura et al. ..... 123/357
4,688,535 A * 8/1987 Kuttner et al. ..... 123/436
4,766,863 A * 8/1988 Fujimori ..... 123/339.21
4,936,277 A * 6/1990 Deutsch et al. ..... 123/436
5,020,502 A * 6/1991 Wild ..... 123/673
5,131,371 A * 7/1992 Wahl et al. ..... 123/436

FOREIGN PATENT DOCUMENTS

JP 61-46444 6/1986 ..... F02D/41/36
JP 3-100351 4/1991 ..... F02D/41/40

* cited by examiner

*Primary Examiner*—Erick Solis
(74) *Attorney, Agent, or Firm*—McCormick, Paulding & Huber LLP

(57) ABSTRACT

A fuel injection control device of an engine having a plurality of cylinders, that prevents sudden change in combustion condition. The control device calculates a basic amount of fuel to be injected into cylinders. The controller then decides an amount of adjustment ultimately made to the basic amount of fuel based on an engine revolution speed difference between the cylinders. The adjustment is stepwise made to the basic amount of fuel so that a total amount of fuel gradually increases or decreases. Since a steep change does not occur in the total amount of fuel, the combustion condition does not change suddenly and the engine does not vibrate.

20 Claims, 5 Drawing Sheets

FLOWCHART OF FUEL INJECTION DETERMINATION (1)

CHANGE IN FINAL FUEL INJECTION

FUEL INJECTION CONTROLLER OF ENGINE

CROSS REFERENCES TO RELATED APPLICATIONS

This application claims priority under 35 USC 119 of Japanese patent application Ser. No. 2000-171176 filed on Jun. 7, 2000, the entire disclosure of which is incorporated herein by reference.

BACKGROUND OF THE INVENTION

1. Field of the Invention

The present invention relates to a fuel injection control apparatus of an engine for correcting amounts of fuel to be injected into respective cylinders of the engine in accordance with engine revolution speed variations between the engine cylinders, which likely occur when the engine is operated in a low speed and light load condition.

2. Description of the Related Art

In general, an engine such as a diesel engine having a plurality of cylinders has manufacturing errors or tolerances in various parts used to build injectors or other parts. In addition, the engine cylinders experience aging. Consequently, the cylinders have different combustion conditions such as different combustion periods and heat generation. As a result, combustions take place in different manners in the cylinders, and therefore the cylinders exert different engine revolution speeds the moment the combustions occur in the cylinders. This occasionally causes engine vibrations which are significant when the engine is operating at a slow speed with a light load.

In order to suppress the engine revolution speed variations between the cylinders, Japanese Patent Application, Laid Open Publication Nos. 61-46444 and 3-100351 proposed measures for amending amounts of fuel to be injected into the respective cylinders. A fuel injection control apparatus disclosed in Japanese Patent Application Laid-Open Publication No. 61-46444 detects engine revolution speeds of the respective cylinders at predetermined crankshaft angles before and after combustion during stable idling, and then adjusts the amounts of fuel injection such that the cylinders have the same revolution speed discrepancy. When the engine is operated outside the idling range, the above adjustment is further adjusted in response to the engine running condition. Accordingly, a driver can experience a smooth driving without engine revolution speed variations regardless of the engine revolution speed and engine load.

Japanese Patent Application Laid-Open Publication 3-100351, which claims priority of DE P 3929746.2 filed Sep. 7, 1989, discloses a fuel injection control apparatus that has a correction means for correcting a fuel feed signal at predetermined intervals when an engine is operated in a stable condition with respect to an exhaust gas temperature, engine revolution speed, engine torque and other aspects at the final stage of the engine manufacturing process. Values detected by sensors are used by a calculation circuit to decide a correction value. This correction value is stored in the form of a map inside a memory in connection with various engine revolution speeds and loads even after the engine is deactivated. This value is utilized again to adjust the deviations in the fuel injection between the cylinders when the engine is restarted.

The engine revolution speed variations cause the engine vibrations when the engine is operated in a low speed-light load condition. Therefore, the above described engine fuel injection adjustment is generally applied to the cylinders when the engine is operated under such a condition. If a considerable change occurs in the engine revolution speed and load, e.g., when the engine running condition switches from the idling to the non-idling condition or vice versa, a steep change is caused in the amount of fuel injection upon changing of the engine running condition because of cancellation or application of the fuel adjustment. This produces impulsive vibrations in the engine, which are in turn transmitted to a driver and passengers in a vehicle as well as a vehicle body.

SUMMARY OF THE INVENTION

An object of the present invention is to overcome the above described problems.

According to one aspect of the present invention, there is provided a fuel injection control apparatus of an engine having a plurality of cylinders including a basic injection calculation means for calculating a basic amount of fuel to be injected into the cylinders in accordance with an engine running condition, an adjustment deciding means for deciding an amount of adjustment ultimately made to the basic amount of fuel on the basis of an engine revolution speed difference detected between the cylinders, an adjustment necessity determination means for determining whether the fuel adjustment is needed or not on the basis of the engine running condition, and a final injection deciding means for deciding a total amount of fuel to be injected into the cylinders on the basis of the basic amount of fuel and the amount of adjustment when the adjustment necessity determination means changes its determination, with the adjustment being made in a stepwise manner such that a steep change does not occur in the total amount of fuel.

The basic fuel calculation means first calculates the basic amount of fuel to be injected based on the engine operating condition. Then, the engine revolution speed difference between the cylinders is detected. In order to cancel this engine revolution speed difference, the adjustment deciding means decides the ultimate amount of adjustment (i.e., total amount of adjustment). In the present invention, this adjustment is not applied to the basic amount of fuel immediately. Before the adjustment is made, the adjustment necessity determination means determines whether the adjustment is needed based on the engine operating condition. When the determination means changes its determination (from yes ("needed") to no ("not needed") or vice versa), the final injection deciding means prepares the stepwise decreasing or increasing scheme applied to the total amount of adjustment. The final injection deciding means then adjusts the total amount of injection based on the basic amount of injection and the stepwise changing amount of adjustment.

When the determination of the adjustment necessity determination means switches from "needed" to "not needed" or vice versa, the amount of adjustment will not be immediately canceled from or added to the basic amount of fuel. Rather, the amount of adjustment is stepwise decreased or increased. Accordingly, the total amount of fuel injection changes gradually. As a result, the combustion condition does not change suddenly, and the engine vibrations do not occur.

When the determination of the adjustment necessity determination means switches from "not needed" to "needed", the final injection deciding means multiplies the difference between the total (or ultimate) adjustment and a previous stepwise adjustment by a predetermined coefficient (less than one), and adds the resulting value to the previous stepwise adjustment to decide the stepwise adjustment of this time. The final injection deciding means then adds this stepwise adjustment to the basic fuel to obtain the total fuel injection of this time. The final injection deciding means does not add the ultimate adjustment to the basic fuel upon determining that the adjustment is needed. If the ultimate adjustment were immediately applied, the total amount of fuel injection would rise steeply. In the present invention, the adjustment gradually increases (or approaches) step by step to the ultimate value.

When the absolute value of the difference between the ultimate amount of adjustment and the previous stepwise amount of adjustment becomes less than a prescribed value, the final injection deciding means adds the ultimate amount of adjustment to the basic amount of injection and uses the resulting value as the total amount of injection of this time. If the absolute value of the difference between the ultimate amount of adjustment and the previous stepwise amount of adjustment is smaller than the prescribed value, the stepwise adjustment is no longer necessary.

When the determination of the adjustment necessity determination means switches from "needed" to "not needed", on the other hand, the final injection deciding means multiplies the difference between zero and a previous stepwise adjustment by a predetermined coefficient (less than one), and adds the resulting value (this value is a negative value) to the previous stepwise adjustment to decide the stepwise adjustment of this time. The final injection deciding means then adds this stepwise adjustment to the basic fuel to obtain the total fuel injection of this time. The final injection deciding means does not subtract the full amount of adjustment from the previous total amount of injection upon determining that the adjustment is not needed. If it occurred, the total amount of fuel injection would drop steeply. In the present invention, the adjustment gradually decreases to zero; the total amount of injection gradually approaches the basic amount of injection.

When the absolute value of the step wise adjustment becomes less than a prescribed value, the final injection deciding means employs the basic amount of injection as the total amount of injection of this time. If the stepwise adjustment is sufficiently small, it is no longer necessary.

Additional objects, benefits and advantages of the present invention will become apparent to those skilled in the art to which this invention relates from the subsequent description of the embodiments and the appended claims, taken in conjunction with the accompanying drawings.

DETAILED DESCRIPTION OF THE INVENTION

Now, an embodiment of the present invention will be described in reference to the accompanying drawings. An engine described herein is an eight-cylinder engine, with the number N (N=1 to 8) being allotted to the respective cylinders. It should be noted that the order of combustion of these cylinders is indicated by "j".

Figure 1:
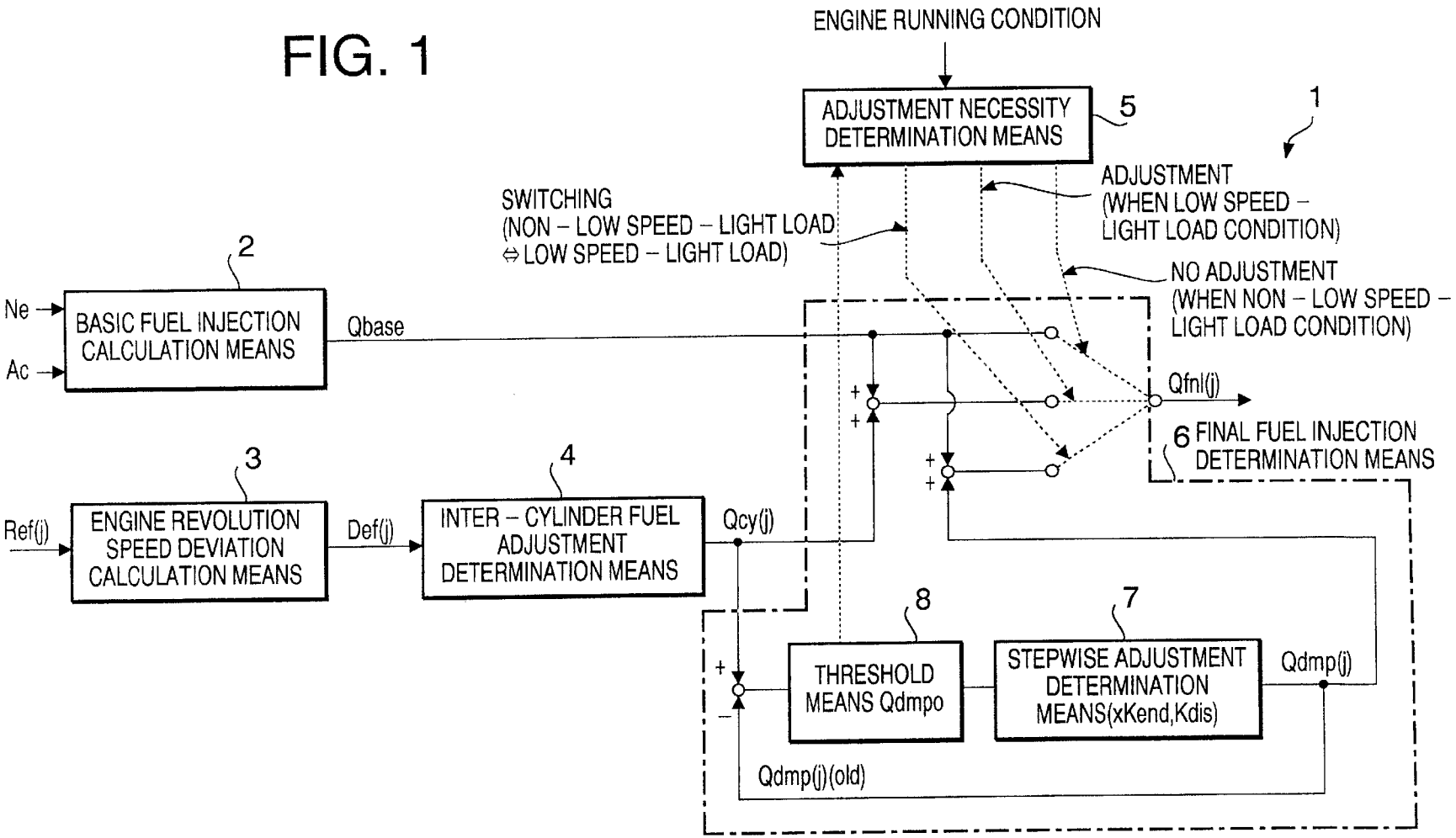
FIG. 1 illustrates a block diagram of an embodiment of a fuel injection control apparatus of an engine according to the present invention.

Referring to FIG. 1, illustrated is a fuel injection control apparatus 1 of the engine that includes a basic fuel injection calculation means 2 for calculating a fundamental amount of fuel injection Qbase in accordance with an engine running condition such as an engine revolution speed Ne and an accelerator movement Ac proportional to depression of an accelerator pedal which reflects an engine load. The fuel injection control apparatus 1 also includes an engine revolution speed deviation calculation means 3 for receiving a signal representing an engine revolution speed Ref(j) of each of the cylinders to calculate an engine revolution speed deviation Def(j), and an inter-cylinder fuel injection adjustment determination means 4 for producing a signal representing an amount of injection adjustment Qcy(j) based on the engine revolution speed deviation Def(j). The fuel injection control apparatus 1 further includes an inter-cylinder adjustment determination means 5 for producing a signal indicating whether an inter-cylinder adjustment in the fuel injection should be performed or not and whether the inter-cylinder adjustment is switched between "performed" and "not performed", in accordance with the engine running condition. If the engine is not operated in a low speed-light load condition, the engine revolution speed deviation between the cylinders is not large so that the fuel injection adjustment is not required. In general, therefore, the inter-cylinder adjustment is not carried out, and a final fuel injection determination means 6 utilizes the basic amount of fuel injection Qbase directly as a final amount of fuel injection Qfn(j).

When the engine is operating in the low speed-light load condition, the inter-cylinder engine revolution speed deviation becomes greater so that the inter-cylinder fuel injection adjustment is needed. In this case, the final fuel injection determination means 6 adds an adjustment fuel Qcy(j) to the basic amount of fuel injection Qbase to obtain the final fuel injection Qfnl(j). Qbase=Qidle when the engine is idling. When the engine operating condition changes from the low speed-light load condition to a non-low speed-light load condition or vice versa, the fuel injection condition is changed from "adjusted" to "not adjusted or vice versa. When such a change occurs, a considerable change is caused in the amount of fuel injection. In order to moderate this change, the fuel injection adjustment is carried out stepwise in this embodiment. Specifically, the final fuel injection determination means 6 decides a final fuel injection Qfnl(j) by adding a most recent stepwise correction Qdam(j) to the basic fuel injection Qbase with respect to each of the cylinders. The most recent stepwise correction Qdam(j) is determined by a stepwise correction determination means 7. Specifically, the stepwise correction determination means 7 calculates a difference between the fuel adjustment Qcy(j) and a previous stepwise correction Qdam(j)(old), multiplies it by a predetermined coefficient, and adds the previous stepwise correction Qdam(j)(old) to it to obtain the most recent stepwise correction Qdmp(j). A determination unit 8 determines whether the difference between the fuel adjustment Qcy(j) and previous stepwise adjustment Qdmp(j)(old) is less than a threshold value Qdmpo. If the answer is yes, the final fuel injection determination means 6 adds the fuel adjustment Qcy(j) to the basic fuel injection Qbase to acquire the final fuel injection Qfnl(j) as will be described in reference to the flowchart of FIG. 4.

Figure 2:
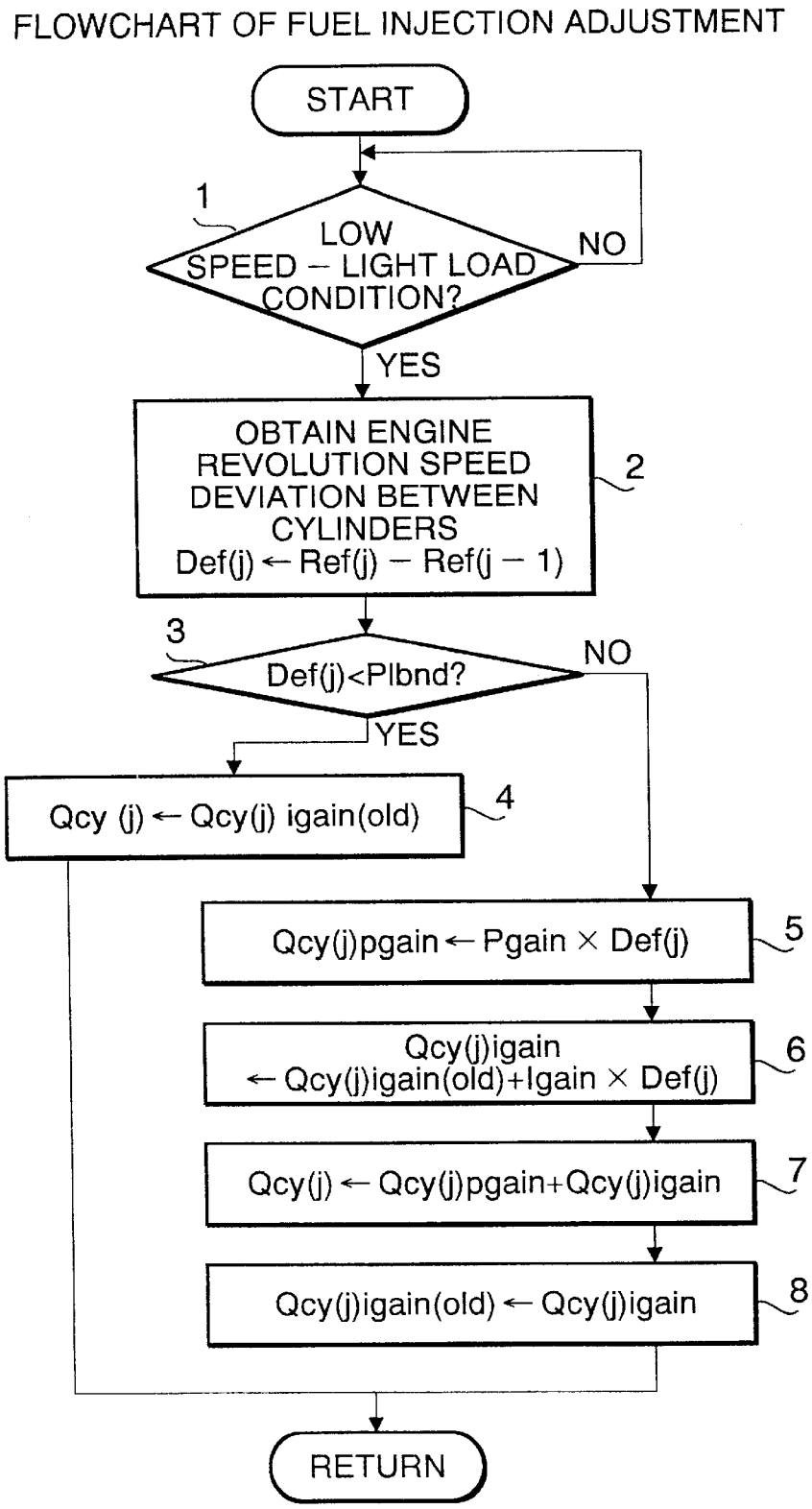
FIG. 2 illustrates a flowchart for determining an inter-cylinder fuel adjustment performed by the control apparatus shown in FIG. 1.

Referring to FIG. 2, illustrated is a flowchart for determining amounts of fuel injection adjustment in the cylinders. It is first determined whether the engine running condition is a low speed-light load condition (Step S1). If the answer is no, the program waits until the engine running condition becomes the low speed-light load condition. When this condition is met (Step S1; Yes), the engine revolution speed deviation between the cylinders is detected (Step S2). Here, the engine revolution speed of a cylinder(j), in which combustion takes place, detected at a predetermined crankshaft angle is referred to as Ref(j). The engine revolution speed deviation Def(j) between this cylinder(j) and a cylinder(j−1) in which a combustion takes place immediately before this cylinder is given by the equation below:

$$\mathrm{Def}(j) \leftarrow \mathrm{Ref}(j) - \mathrm{Ref}(j-1)$$

If j=1, a cylinder (j−1) is a last cylinder of a combustion cycle.

It is then determined whether the engine revolution speed difference Def(j) between the two cylinders is smaller than a control value PIbnd (Step S3). If Def(j) is not smaller than this control value PIbnd, a proportional integration control is effected. If the answer is yes at Step S3, a previous fuel injection adjustment Qcy(j)igain(old) is directly used as a current fuel injection adjustment Qcy(j) for all the cylinders (Step S4). It should be noted that the fuel injection adjustment control is performed an integral control, and Qcy(j) igain is the fuel injection adjustment obtained by the integral gain (igain).

If Def(j) is less than PIbnd at Step S3, e.g., when the engine is started, the fuel injection adjustment Qcy(j)pgain obtained by the proportional control is calculated by multiplying the engine revolution speed difference Def(j) by the proportional gain Pgain (Step S5). Subsequently, the fuel injection adjustment Qcy(j)igain by the current integral control is calculated by adding the previous fuel injection adjustment Qcy(j)igain(old) to a value resulting from multiplying the engine revolution speed difference Def(j) by the integral gain Igain (Step S6). After that, the first fuel injection adjustment Qcy(j)pgain obtained at Step S5 and the second fuel injection adjustment Qcy(j)jgain obtained at Step S6 are added to each other to calculate the current fuel injection adjustment Qcy(j) (Step S7). In order to prepare a fuel injection adjustment Qcy(j)igain for the next integral control, the previous integral control-based fuel injection adjustment Qcy(i)igain(old) is placed by the current integral control-based fuel injection adjustment Qcy(i)igain (Step S8).

Figure 3:
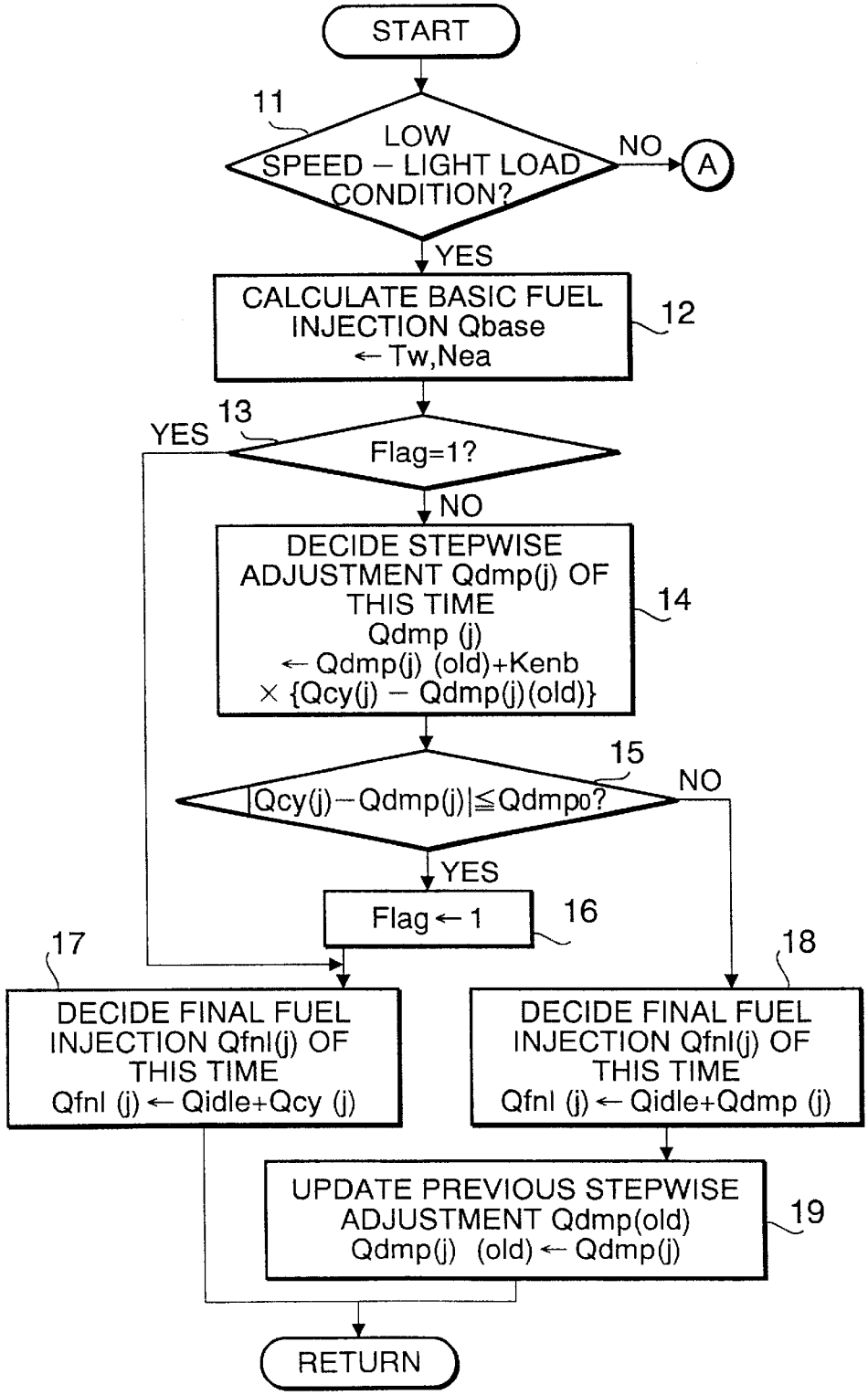
FIG. 3 illustrates a flowchart for determining a final amount of fuel injection when the stepwise increasing inter-cylinder adjustment is performed by the control apparatus shown in FIG. 1.

Referring to FIG. 3, illustrated is a flowchart for deciding a final amount of fuel injection. In this flowchart, it is first determined whether the engine is operated under the low speed-light load condition (Step S11). If the answer is yes, the basic fuel injection calculation means 2 calculates the basic amount of fuel injection Qbase in the idling condition based on the engine cooling water temperature Tw and the actual engine revolution speed Nea detected by associated sensors (Step S12). It is then determined whether a flag is one or not (Step S13). Here, the flag=1 means the stepwise fuel injection adjustment (from a no adjustment state to a full adjustment state) is complete. If the flag=1, the program proceeds to Step S17.

If the flag≠1, on the other hand, the stepwise fuel injection adjustment should continue so that the following process is executed for the respective cylinders; a difference between the fuel injection adjustment Qcy(j) obtained at Step S7 (FIG. 2) and the previous stepwise fuel injection adjustment Qdmp(j)(old) is multiplied by a coefficient Kenb less than one (e.g., 0.5) and the resulting value is added to the previous stepwise adjustment Qdmp(j)(old) to obtain the current stepwise adjustment Qdmp(j) (Step S14).

$$Qdmp(j)=Qdmp(j)(\mathrm{old})+Kenb\times\{Qcy(\mathrm{j})-\mathrm{Qdmp}(j)(\mathrm{old})\}$$

After that, it is determined whether the absolute value of the difference between the fuel injection adjustment Qcy(j) and the current stepwise adjustment Qdmp(j) is not greater than a predetermined value Qdmpo (Step S15). As the stepwise fuel injection adjustment process proceeds, the stepwise adjustment Qdmp(j) approaches the ultimate fuel adjustment Qcy(j). The flag eventually becomes one when the absolute value of the difference between Qdmp(j) and Qcy(j) becomes equal to or smaller than the predetermined value Qdmpo (Step S16). The full adjustment Qcy(j) is then added to the basic fuel injection Qbase to obtain the final fuel injection Qfnl(j) (Step S17). Since the flag=1, the answer at Step S13 is yes when this flowchart is executed next time, so that the program always jumps to Step S17 from the next time. The flag is set to 0 when the ignition takes place in the engine, and switched to 1 when there is no necessity to adjust the fuel injection between the cylinders in the stepwise manner.

When the determination at Step S15 is disaffirmative, the stepwise adjustment Qdmp(j) is not sufficiently close to the ultimate adjustment Qcy(j). Thus, the stepwise adjustment Qdmp(j) is added to the basic fuel injection Qbase and the resulting value is used as the final fuel injection Qfnl(j) (Step S18). Subsequently, the previous stepwise adjustment Qdmp (j)(old) is updated by the current stepwise adjustment Qdmp (j) (Step S19). This is a preparation of the next execution of the flowchart (1) shown in FIG. 3.

Figure 4:
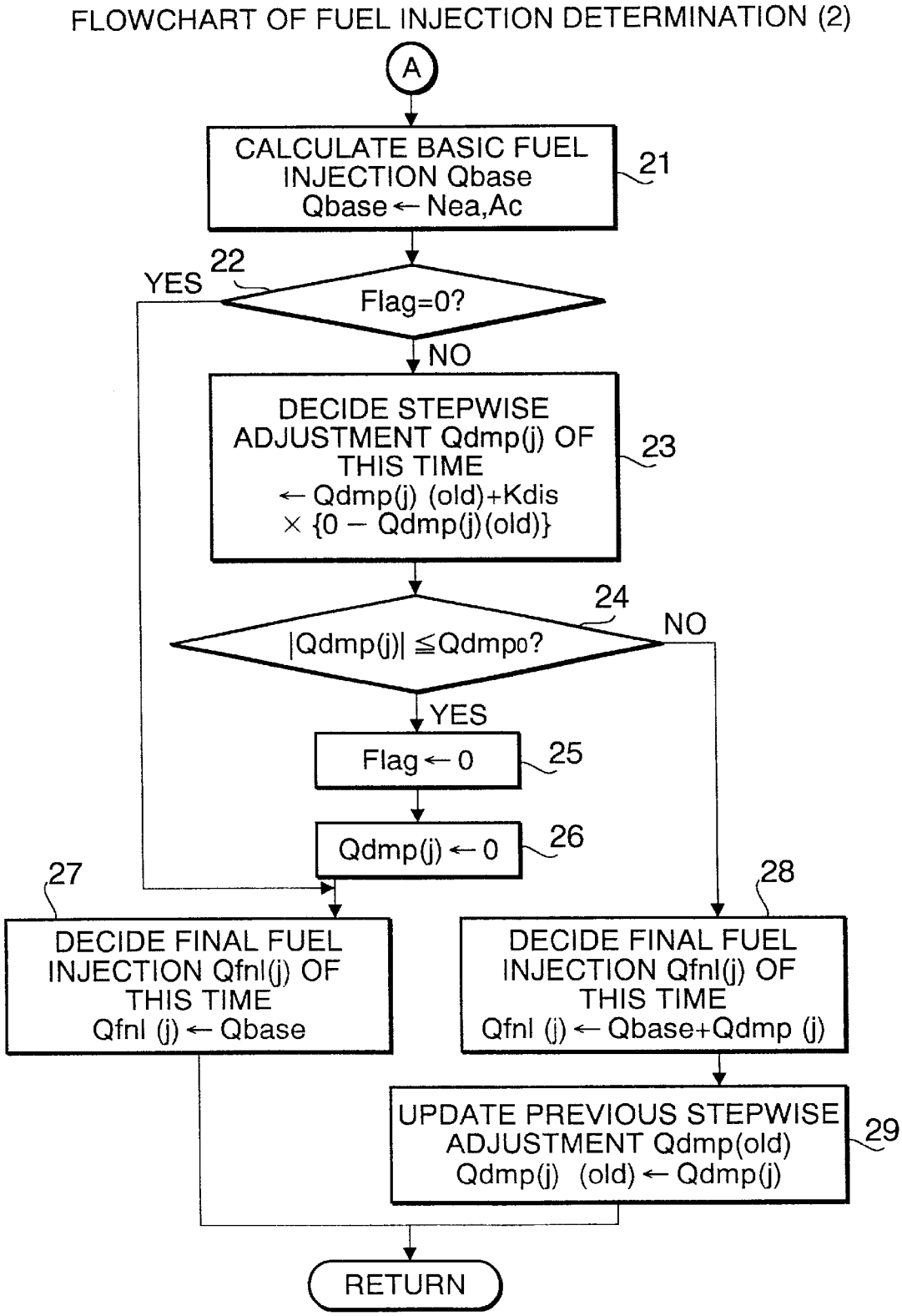
FIG. 4 illustrates a flowchart for determining a final amount of fuel injection when the stepwise decreasing inter-cylinder adjustment is performed.

When it is determined at Step S11 that the engine operating condition shifts from the low speed-light load condition to the non-low speed-light load condition, the control program switches to the flowchart of FIG. 4. Firstly the basic fuel injection Qbase is calculated from the actual engine revolution speed Nea and the accelerator movement Ac such as depression of the accelerator pedal (Step S21). It is then determined whether the stepwise adjustment completion flag is 0 (Step S22). If the answer is not affirmative, the stepwise adjustment is not sufficiently close to the full adjustment value so that the stepwise adjustment should continue. Because the engine is now operating in the non-low speed-light load condition, it is necessary to terminate the inter-cylinder fuel adjustment; the fuel adjustment is no longer needed. It should be noted here that the current fuel injection includes the adjustment value Qcy(j), which is a considerable amount of fuel. Therefore, the stepwise or gentle decrease, not steep or sudden decrease, should take place in canceling the fuel adjustment. Specifically, the difference between zero fuel adjustment and the previous stepwise adjustment Qdmp(j)(old) is multiplied by a predetermined coefficient Kdis less than one (e.g., 0.5) and the resulting negative value is added to the previous stepwise adjustment Qdmp(j)(old) to obtain a new stepwise adjustment Qdmp(j) as shown in the below equation (Step S23).

$$Qdmp(j)=Qdmp(j)(\mathrm{old})+Kdis\times\{0-Qdmp(j)(\mathrm{old})\}$$

Here, the initial value of Qdmp(j) is a value Qcy(j) of just before Qcy(j) that satisfies the determination condition of Step S15.

It is then determined whether the absolute value of the stepwise adjustment Qdmp(j) becomes equal to or less than the prescribed value Qdmpo (Step S24). That is, it is determined whether the stepwise fuel adjustment sufficiently proceeds and the stepwise adjustment Qdmp(j) approaches zero. If the answer is affirmative, the flag becomes 0 (Step S25), and the stepwise adjustment Qdmp(j) becomes 0 (Step S26). The basic fuel injection Qbase is used as the final fuel injection Qfnl(j) (Step S27). If the engine operating condition is the low speed-light load condition when the flowchart of FIG. 3 is executed next time or later, the answer at Step S11 is affirmative and the answer at Step S13 is disaffirmative because the flag is zero. Consequently, the stepwise fuel adjustment is started and conducted as shown in Step S14 and subsequent steps.

When the determination result at Step S24 is negative, the stepwise adjustment Qdmp(j) is not sufficiently close to zero so that the stepwise adjustment Qdmp(j) is added to the basic fuel injection Qbase to obtain the final fuel injection Qfnl(j) (Step S28). After that, the previous stepwise adjustment Qdmp(j)(old) is updated by the current stepwise adjustment Qdmp(j) (Step S29) in order to prepare for the next execution of the flowchart of FIG. 4.

Figure 5:
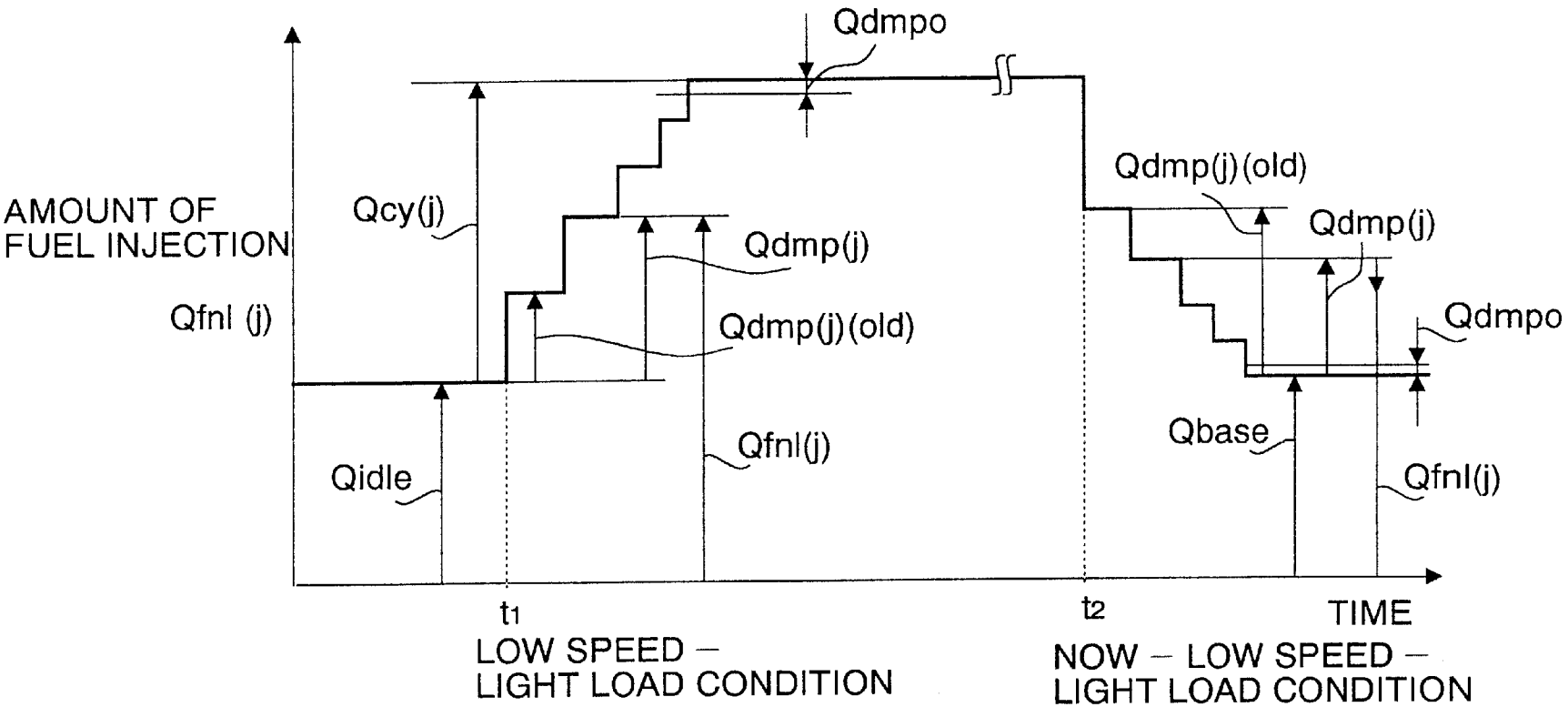
FIG. 5 is a diagram depicting the changing total amount of fuel with the stepwise increasing and decreasing fuel adjustment.

The operation of the fuel injection control apparatus 1 is illustrated in a diagram shown in FIG. 5. The engine operating condition switches into the low speed-light load condition at the time t1. In order to effect the inter-cylinder fuel adjustment, the fuel adjustment is started and an amount of adjustment Qcy(j) is decided. In the illustrated example, the amount of fuel adjustment Qcy(j) has a positive value. It should be noted, however, that the inter-cylinder fuel adjustment may have a negative value. The stepwise adjustment Qdmp(j) is added to the basic amount Qbase such that the repeated stepwise adjustment substantially sums up to the ultimate adjustment Qcy(j). The final fuel injection Qfnl(j) is determined by adding Qcy(j) to Qbase. When the difference between the total adjustment Qcy(j) and the stepwise adjustment Qdmp(j) is smaller than the predetermined value Qdmpo, the final fuel injection Qfnl(j) is equal to the sum of the basic fuel Qbase and the total adjustment Qcy(j).

When the engine running condition switches to the non-low speed-light load condition from the low speed-light load condition at the time t2, the base fuel injection Qbase is calculated. In this case, the inter-cylinder adjustment is no longer required so that the stepwise adjustment Qdmp(j) to be added to the base fuel injection Qbase is gradually reduced to zero. The final fuel injection Qfnl is determined by adding the stepwise adjustment to the basic fuel injection. When the absolute value of the stepwise adjustment Qdmp (j) drops below the predetermined value Qdmpo, the final amount of fuel injection becomes equal to the basic amount of fuel injection Qbase.

What is claimed is:

1. A fuel control apparatus for controlling fuel injection of an engine having a plurality of cylinders, comprising:

basic fuel calculation means for calculating a basic amount of fuel to be injected to respective cylinders of an engine in accordance with an engine running condition;

adjustment deciding means for deciding a total amount of adjustment to be ultimately applied to the basic amount of fuel on the basis of an engine revolution speed deviation between the respective cylinders;

adjustment necessity determination means for determining whether the adjustment is needed to the basic fuel on the basis of the engine running condition; and final fuel deciding means for deciding a total amount of fuel to be injected into the respective cylinders on the basis of the basic amount of fuel and a stepwise adjustment, which increases stepwise to or decreases stepwise from the total amount of adjustment, when the adjustment necessity determination means changes its determination.

2. The fuel control apparatus according to claim 1, wherein the adjustment necessity determination means determines that the adjustment is needed to the basic fuel when the engine is in a low speed-light load condition, and does not determine that the adjustment is needed when the engine is in a non-low speed-light load condition.

3. The fuel control apparatus according to claim 2, wherein the engine is in the low speed-light load condition when it is idling.

4. The fuel control apparatus according to claim 1, wherein the final fuel deciding means multiplies a difference between the total amount of adjustment and a previous stepwise adjustment by a predetermined coefficient and adds a resulting value to the previous stepwise adjustment to obtain a stepwise adjustment of this time when the adjustment necessity determination means changes its determination from "adjustment not needed" to "needed", and then adds the stepwise adjustment of this time to the basic amount of fuel to decide a total amount of fuel of this time.

5. The fuel control apparatus according to claim 4, wherein the predetermined coefficient is smaller than one.

6. The fuel control apparatus according to claim 4, wherein the final fuel deciding means decides the total amount of fuel by adding the total amount of adjustment to the basic amount of fuel when an absolute value of a difference between the total amount of adjustment and a current stepwise adjustment becomes smaller than a predetermined value.

7. The fuel control apparatus according to claim 1, wherein the final fuel deciding means multiplies a difference between zero and a previous stepwise adjustment by a predetermined coefficient and adds a resulting negative value to the previous stepwise adjustment to obtain a stepwise adjustment of this time when the adjustment necessity determination means changes its determination from "adjustment needed" to "not needed", and then adds the stepwise adjustment of this time to the basic amount of fuel to decide a total amount of fuel of this time.

8. The fuel control apparatus according to claim 7, wherein the predetermined coefficient is smaller than one.

9. The fuel control apparatus according to claim 7, wherein the final fuel deciding means takes the basic amount of fuel as the total amount of fuel when an absolute value of the current stepwise adjustment becomes smaller than a predetermined value.

10. The fuel control apparatus according to claim 1, wherein the engine is a diesel engine.

11. A vehicle comprising:

an engine;

wheels;

a vehicle body; and a fuel injection control apparatus according to claim 10.

12. A fuel control method for controlling fuel injection in an engine having a plurality of cylinders, comprising the steps of:

A) calculating a basic amount of fuel to be injected to respective cylinders of an engine in accordance with an engine running condition;

B) deciding a total amount of adjustment to be ultimately applied to the basic amount of fuel on the basis of an engine revolution speed deviation between the respective cylinders;

C) determining whether or not the adjustment is needed to the basic fuel on the basis of the engine running condition; and D) deciding a total amount of fuel to be injected into the respective cylinders on the basis of the basic amount of fuel and a stepwise adjustment, which increases stepwise to or decreases stepwise from the total amount of adjustment, when the step D changes its determination.

13. The fuel control method according to claim 12, wherein the step C determines that the adjustment is needed to the basic fuel when the engine is in a low speed-light load condition, and does not determine that the adjustment is needed when the engine is in a non-low speed-light load condition.

14. The fuel control method according to claim 13, wherein the engine is in the low speed-light load condition when it is idling.

15. The fuel control method according to claim 12, wherein the step D includes multiplying a difference between the total amount of adjustment and a previous stepwise adjustment by a predetermined coefficient and adding a resulting value to the previous stepwise adjustment to obtain a stepwise adjustment of this time when the step C changes its determination from "adjustment not needed" to "needed", and then adding the stepwise adjustment of this time to the basic amount of fuel to decide a total amount of fuel of this time.

16. The fuel control method according to claim 15, wherein the predetermined coefficient is smaller than one.

17. The fuel control method according to claim 15, wherein the step D decides the total amount of fuel by adding the total amount of adjustment to the basic amount of fuel when an absolute value of a difference between the total amount of adjustment and a current stepwise adjustment becomes smaller than a predetermined value.

18. The fuel control method according to claim 12, wherein the step D includes multiplying a difference between zero and a stepwise adjustment by a predetermined coefficient and adding a resulting negative value to the previous stepwise adjustment to obtain a stepwise adjustment of this time when the step C changes its determination from "adjustment needed" to "not needed", and then adding the stepwise adjustment of this time to the basic amount of fuel to decide a total amount of fuel of this time.

19. The fuel control method according to claim 18, wherein the predetermined coefficient is smaller than one.

20. The fuel control method according to claim 18, wherein the step D decides that the basic amount of fuel is the total amount of fuel when an absolute value of the current stepwise adjustment becomes smaller than a predetermined value.

* * * * *